US006055913A

United States Patent [19]

Gerber et al.

[11] Patent Number: 6,055,913

[45] Date of Patent: May 2, 2000

[54] COAL SPREADER WITH SWIRL VANES

[75] Inventors: David W. Gerber, Massillon; Bryan Hand, Norton, both of Ohio

[73] Assignee: The Babcock & Wilcox Company, New Orleans, La.

[21] Appl. No.: 08/959,795

[22] Filed: Oct. 29, 1997

[51] Int. Cl.[7] ..... F23K 3/02

[52] U.S. Cl. ..... 110/104 B; 110/104 B; 110/261; 110/264; 123/592; 29/889; 29/889.6; 29/890.02

[58] Field of Search ..... 29/889, 889.21, 29/889.22, 889.23, 889.3, 889.4, 889.6, 889.61, 890.02; 110/104 B, 101 R, 110, 115, 260, 261, 262, 263, 264, 265; 123/23, 527, 592

[56] References Cited

U.S. PATENT DOCUMENTS

| | | | |
|---|---|---|---|
| 2,045,357 | 6/1936 | Hoffman . | |
| 3,945,361 | 3/1976 | Piotrowicz, Sr. | 123/592 X |
| 4,422,432 | 12/1983 | Knox, Sr. | 123/592 |
| 4,478,607 | 10/1984 | Capps | 123/592 X |
| 5,113,771 | 5/1992 | Rini et al. | 110/263 |
| 5,137,005 | 8/1992 | Kirby | 123/592 |
| 5,231,937 | 8/1993 | Kobayashi et al. | 110/262 |
| 5,529,000 | 6/1996 | Hartel et al. | 110/347 |
| 5,542,361 | 8/1996 | Lilja et al. | 110/341 |
| 5,568,777 | 10/1996 | Breen et al. | 110/261 |
| 5,890,477 | 4/1999 | Nazare | 123/592 |

*Primary Examiner*—Ira S. Lazarus
*Assistant Examiner*—Ljiljana V. Ciric
*Attorney, Agent, or Firm*—Robert J. Edwards; Daniel S. Kalka

[57] ABSTRACT

An integrally cast, non-welded coal spreader for a furnace or boiler burner has integrally cast swirl vanes. A shaft of the spreader extends into the hollow interior of a cap of the spreader and the vanes extend outwardly of the cap and are cast as one piece with the cap.

7 Claims, 2 Drawing Sheets

COAL SPREADER WITH SWIRL VANES

BACKGROUND OF THE INVENTION

1. FIELD OF THE INVENTION

The present invention relates generally to the field of fossil fuel burners and combustion in power generation furnaces and boilers, and in particular to a new and useful coal spreader configuration for a furnace or boiler burner.

2. DESCRIPTION OF THE RELATED ART

A well-known coal spreader for boiler burners is made by a company called RILEY. Coal spreaders produced by this company have swirl vanes mounted to an axial shaft in a burner throat. The shaft or support rod end carrying the vanes is positioned adjacent the boiler furnace opening. The end of the support rod of the known coal spreader has a plate welded to the support rod.

The welded plate connection may fail in the high temperature environment of a furnace burner. Any such failure is attributable in part to the fact that the hottest part of the furnace is adjacent the tip of the coal spreader.

The materials used in prior coal spreaders also contribute to materials failure from erosion damage among other things.

SUMMARY OF THE INVENTION

It is an object of the present invention to provide an improved coal spreader having a longer usable life and increased wear resistance within a burner environment.

Accordingly, a coal spreader is provided having an elongated shaft with a cast end cap fit over the shaft and secured in place by studs or pins. The end cap has cast swirl vanes for spreading coal attached to the sides of the end cap. The end cap is made of high temperature tolerance materials and lacks welds, thereby improving the usable life of the coal spreader.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
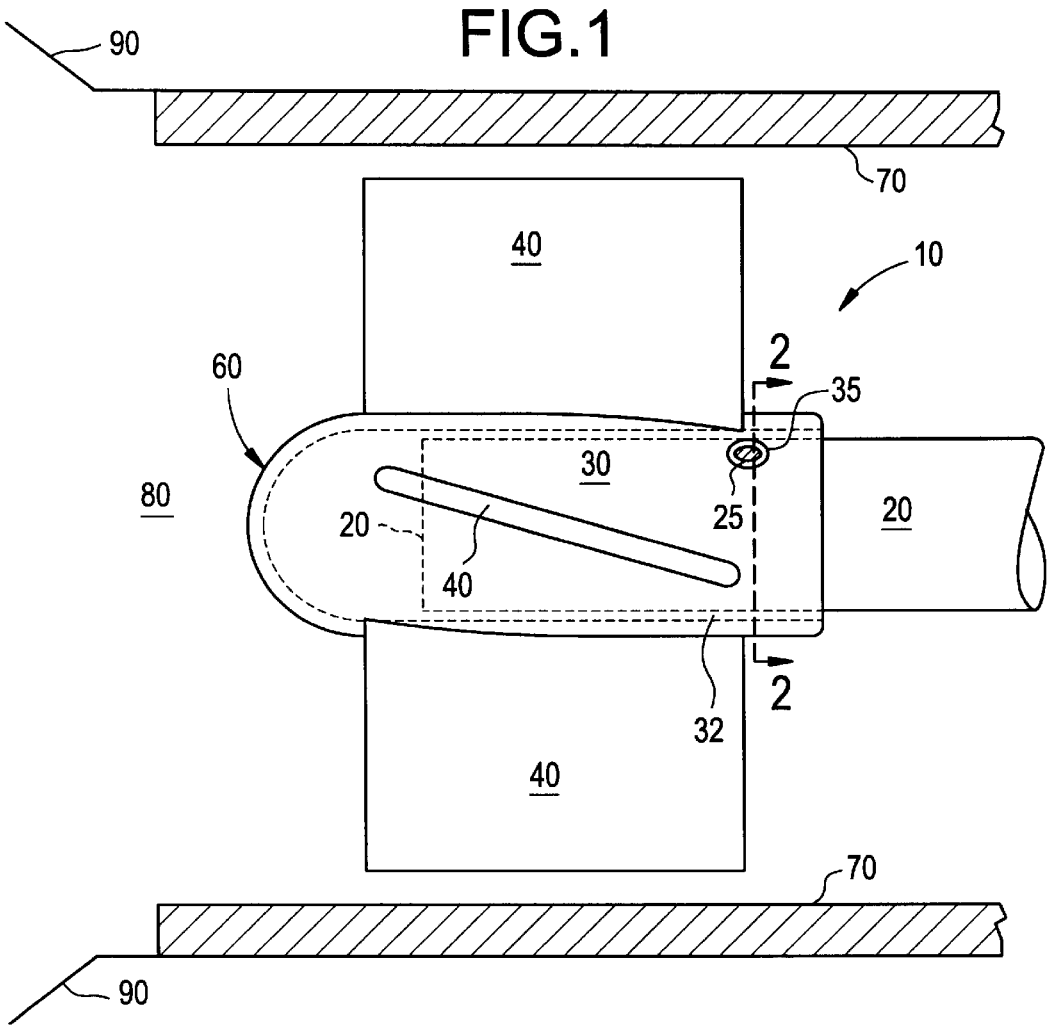
FIG. 1 is a side elevational view of a coal spreader of the invention.

Referring now to the drawings, in which like reference numerals are used to refer to the same or similar elements, FIG. 1 shows coal spreader 10 having shaft 20 supporting end cap 30. Shaft 20 is typically located along the longitudinal axis of a burner 70 in a furnace 80, and extends toward the throat 90 of the burner all shown schematically only.

End cap 30 is cylindrical with a rounded nose 60, and has an opening 32 at one end corresponding to the size of shaft 20. End cap 30 fits over the furnace end of shaft 20 so that their longitudinal axes are coextensive. The interior of the end cap 30 is substantially hollow so that the shaft 20 may be inserted through almost the entire length of the end cap 30, if desired. Only the portion of end cap 30 forming rounded nose 60 is inaccessible by shaft 20.

Swirl vanes 40 are integrally cast with end cap 30 and extend radially outward from the surface of end cap 30. Swirl vanes 40 are oriented at an inclined angle relative to the longitudinal axes of the shaft 20 and end cap 30.

End cap 30 is a single cast piece which fits over the end of shaft 20. End cap 30 is preferably made from a material known as B&W 1601 material, which is an ASTM-A560/560M-93, Grades 50—50 CrNi, 60-40 CrNi, 50—50 CrNiCb. "B&W" is a trademark of McDermott Incorporated. This conforms ASTM A781/A781M, and like material. This particular material is highly resistant to elevated temperatures and has improved wear characteristics over materials known for use with prior coal spreaders and is a high-temperature and heat-resistant stainless steel material.

Figure 2:
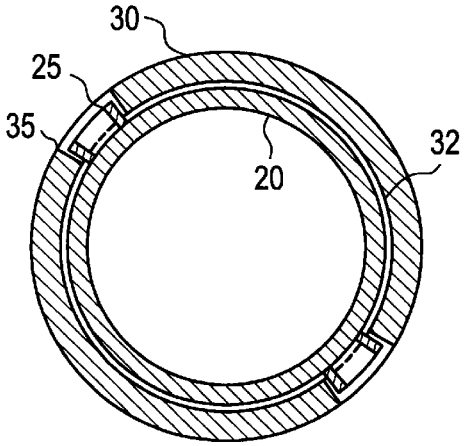
FIG. 2 is a sectional view taken along line 2—2 of FIG. 1.

End cap 30 is secured in place as by studs 25 through openings 35. FIG. 2 shows the studs 25 attached to shaft 20 positioned within openings 35. A pair of openings 35 oriented 180° apart are preferably used to secure the end cap 30 to the shaft 20. The openings 35 are sufficiently large to allow the studs 25 to be secured to the shaft 20 after the end cap 30 is mounted over the end of the shaft 20.

Figure 3:
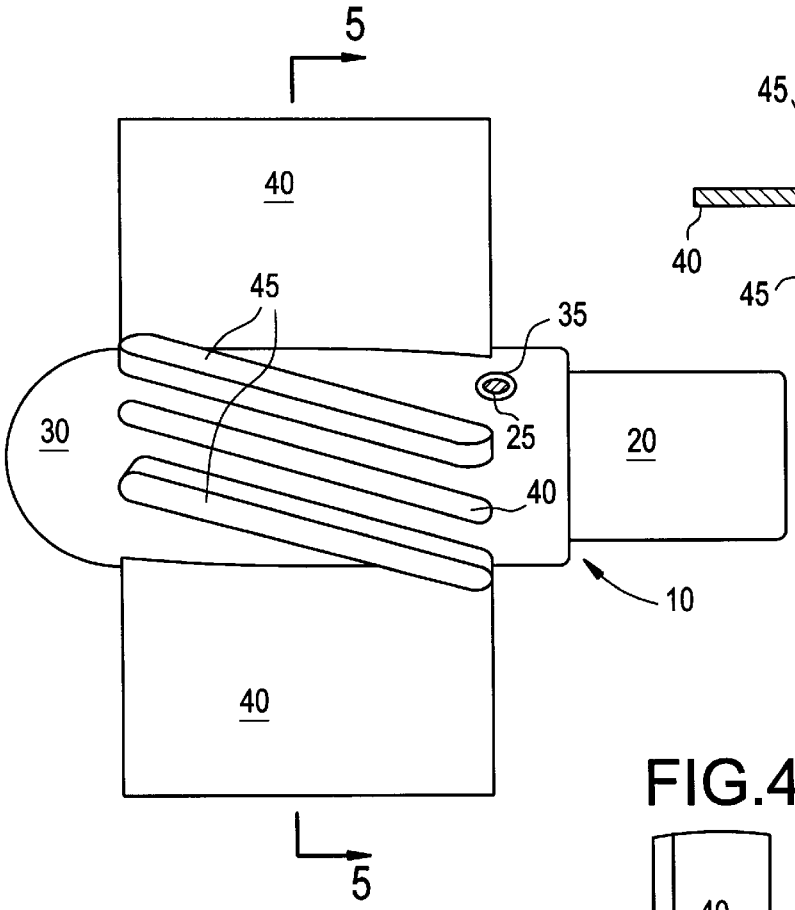
FIG. 3 is a side elevational view of another embodiment of the coal spreader.
Figure 4:
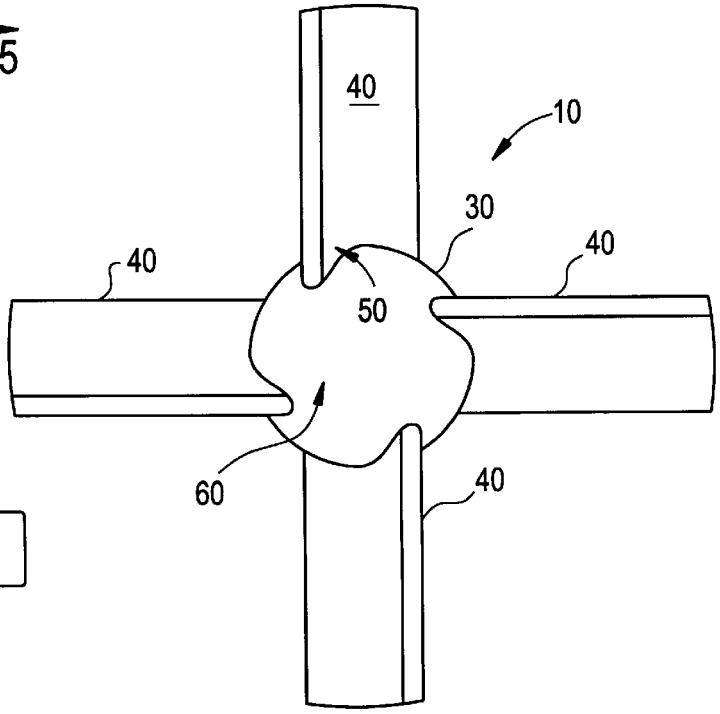
FIG. 4 is a front elevational view of a third embodiment for the coal spreader.

Alternate swirl vane arrangments are shown in FIGS. 3 and 4.

Figure 5:
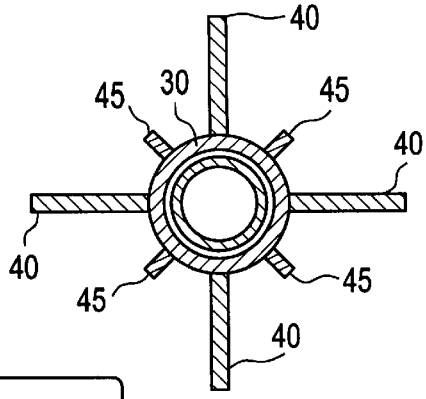
FIG. 5 is a sectional view taken along line 5—5 of FIG. 3.

Additional stub vanes 45 are cast between swirl vanes 40 in the arrangement shown in FIG. 3. The stub vanes 45 are oriented extending radially outward from end cap 30 at the same inclined angle as the swirl vanes 40. The stub vanes 45 may have the same length as swirl vanes 40 or preferably have a shorter length. The additional stub vanes 45 are useful for further enhancing the flow distribution of coal within the burner. See FIG. 3 and 5.

Figure 6:
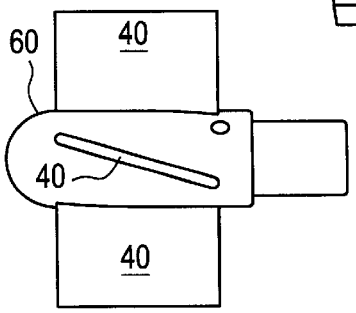
FIG. 6 is a partial side elevational view of FIG. 4.

In FIGS. 4 and 6, the swirl vanes 40 extend over end cap nose 60. The swirl vanes 40 and end cap 30 are integrally cast and are otherwise the same as the embodiment shown in FIG. 1.

While specific embodiments of the invention have been shown and described in detail to illustrate the application of the principles of the invention, it will be understood that the invention may be embodied otherwise without departing from such principles.

We claim:

1. A spreader for a burner, comprising:

a non-welded cylindrical end cap having at least four swirl vanes spaced apart from each other and extending radially outward from the end cap and integrally cast with the end cap as one piece;

support means for holding the end cap at a position in the burner;

the support means comprising an elongated shaft, the end cap having an opening at one end complementary to the elongated shaft for receiving said shaft to support the end cap on said shaft; and attachment means for securing the end cap to the shaft, the attachment means comprising a pair of diametrically opposed openings through a side of the end cap and a pair of studs or pins, one of the pair of studs or pins being secured to the elongated shaft through one of the pair of diametrically opposed openings, the other of the pair of studs or pins being secured to the shaft through the other of the pair of diametrically opposed openings.

2. A spreader according to claim 1, wherein the end cap further comprises a plurality of stub vanes integrally cast with the end cap as one piece with the end cap, at least one stub vane located between an adjacent pair of swirl vanes of said at least four swirl vanes.

3. A spreader according to claim 1, wherein the end cap has a rounded nose, the swirl vanes extending over at least a portion of the rounded nose.

4. A spreader according to claim 1, wherein the end cap further comprises a plurality of stub vanes integrally cast with the end cap as one piece therewith, at least one stub vane located between an adjacent pair of swirl vanes of said at least four swirl vanes.

5. A spreader according to claim 1, wherein the end cap has a rounded nose, the swirl vanes extending over at least a portion of the rounded nose.

6. A spreader according to claim 1, wherein the end cap is cast from stainless steel material.

7. A spreader according to claim 1, wherein the end cap is cast from a high-temperature and heat-resistant stainless steel material.

* * * * *